US005960472A

United States Patent [19]

Reid

[11] Patent Number: 5,960,472

[45] Date of Patent: Oct. 5, 1999

[54] PORTABLE GARMENT PROTECTOR

[76] Inventor: Ana M. Reid, 3039 Randleman Ct., Oviedo, Fla. 32765

[21] Appl. No.: 09/143,050

[22] Filed: Aug. 28, 1998

Related U.S. Application Data

[60] Provisional application No. 60/066,987, Nov. 29, 1997.

[51] Int. Cl.[6] ..... A41D 13/04

[52] U.S. Cl. ..... 2/48; 2/46; 2/338; 2/49.1

[58] Field of Search ..... 2/46, 47, 48, 338, 2/49.1, 49.2, 49.3, 51, 52, 50, 92, 247, 249; 224/660, 662, 663, 664, 665

[56] References Cited

U.S. PATENT DOCUMENTS

| | | | |
|---|---|---|---|
| D. 325,115 | 4/1992 | Vassar, Sr. | D2/229 |
| 2,224,746 | 12/1940 | Richstein | 2/48 |
| 2,265,690 | 12/1941 | Fiedler | 2/48 |
| 2,317,176 | 4/1943 | Byrd | 2/48 |
| 4,459,703 | 7/1984 | Kosmas et al. | 2/48 |
| 4,602,386 | 7/1986 | Hoffman et al. | 2/48 |
| 4,660,224 | 4/1987 | Ashcraft | 2/48 |
| 4,924,527 | 5/1990 | Hintermeyer | 2/49 |
| 5,003,634 | 4/1991 | Brinkman | 2/46 |
| 5,075,897 | 12/1991 | Daniels | 2/2 |
| 5,107,545 | 4/1992 | Potter | 2/46 |
| 5,181,275 | 1/1993 | Spulgis | 2/48 |
| 5,218,721 | 6/1993 | Mathews et al. | 2/49 R |
| 5,220,692 | 6/1993 | Cox | 2/48 |
| 5,244,278 | 9/1993 | Robitaille | 383/4 |
| 5,377,359 | 1/1995 | Jiang | 2/48 |
| 5,457,820 | 10/1995 | Yielding | 2/49.1 |
| 5,509,141 | 4/1996 | Saltzman | 2/49.2 |
| 5,621,916 | 4/1997 | Bell | 2/48 |

*Primary Examiner*—Amy B. Vanatta

*Attorney, Agent, or Firm*—Brian S. Steinberger; Law Offices of Brian S. Steinberger

[57] ABSTRACT

A portable garment protector device for allowing a wearer to deploy upper and lower torso sheath portions from a belt attached front container. The upper and lower torso sheaths are made of absorbent material overlying a water repellent material for protecting a wearer's chest, lap, thighs legs and knees from spilled liquids and foods. Also, side edge and bottom edge channels attached to the device prevent splashing liquid and food from touching the sides and lower leg areas of the wearer. An optional collection basin in front of the device can further collect additional spilled food and liquid. To use, the wearer unzips the container, and unravels both the upper and lower halves of the device over their upper and lower extremities. Additional adjustable neck straps allow the device to be used with different sized users. Wearer's can use the device on seatbelts as both a passenger and a driver in a vehicle, as well as just on the front of their normally worn clothing belt. Other variations include containing the upper and lower portions on spring loaded axle pins. The invention can include using only materials that can be washed for reuse. Alternatively, the invention can include rollers of disposable sheaths allowing the user to separate preperforated edges between each set of torso protection portions.

19 Claims, 7 Drawing Sheets

PORTABLE GARMENT PROTECTOR

This application claims the benefit of Provisional Ser. No. 60,066,987 filed Nov. 29, 1997.

This invention relates to clothing protection devices, and in particular to a device for protecting both upper and lower torso covering garments from liquid and solid spills.

BACKGROUND AND PRIOR ART

It has become increasingly popular for drivers and passengers in vehicles to be eating and drinking while in transit. Often the result is that many spills occur due to the movement of the vehicle, and sudden acceleration and breaking of the vehicle.

It has been well known for drivers and passengers to cover their upper torso with a paper napkin, but this does not protect them from liquid spills. Also, shirts and blouses may be protected from spills with a napkin, but the lap and thigh areas are not protected.

Attempts have been made over the years to overcome these problems but with little success. U.S. Pat. No. 4,660,224 to Ashcraft describes a disposable unisex bib-apron. However, Ashcraft has no connections to a user's belt, nor a stowage container, nor side spillage protection, nor manner in which to provide protection from liquids. U.S. Pat. No. 4,924,527 to Hintermeyer describes a garment protector. However, Hintermeyer has no lower torso and leg protection, no connections to a user's belt. Hintermeyer's device is non-absorbent, and there is no side protection from spillage. U.S. Pat. No. 5,075,897 to Daniels describes a multi-purpose protective garment. However, the Daniels device is rigid, non-adjustable device and does not provide any side protection from spillage, nor use any belt connectors nor has any storage container. U.S. Pat. No. 5,220,692 to Cox discloses a driver's apron. However, there is no side protection from spillage, no convenient storage capability, and is non-absorbent (therefore does not provide liquid spillage protection). U.S. Pat. No. 5,244,278, to Robitaille discloses a combination travel pouch and all purpose cloth. However, Robitaille does not provide any side protection from spillage, nor any connectors to a user's belt. Furthermore, Robitaille must be used as either a lap protector, or an upper torso protector. U.S. Pat. No. 5,530,968 to Crockett discloses a commuter's apron. However, Crockett does not provide a method for convenient stowage, provide any lower torso or leg protection, nor is it manufactured of absorbency material to protect from liquid spillage. Also, Crockett has no suitable method for containment of any liquid spillage, and there is no side protection from spillage. U.S. Pat. No. 5,621,916 to Bell discloses a bib for use while operating a vehicle. However, Bell does not have a convenient method for stowage, is not made of an absorbent material, and does not provide a method of protection from side spillage. Also, Bell is designed only for the use of the operator of the vehicle, and has no method of connecting their device to a user's belt. U.S. Pat. No. Des. 325,115 to Vassar describes a combination bib and lap tray. However, Vassar does not describe the type of material used, nor specify any spill guards, nor any connection to a user's belt, nor any type of storage container. U.S. Pat. No. 4,459,703 to Kosmas et al. describes a seat protection device. However, Kosmas describes using their device to only protect a skier's seat. Kosmas does not describe protecting the upper torso in any manner. U.S. Pat. No. 4,602,386 to Hoffman et al. describes an apron. However, Hoffman describes a bulky and not easily storable "radiology apron having radiation protection material such as lead", abstract. Hoffman does not have any side spillage guards nor any storage containers for their device. U.S. Pat. No. 5,107,545 to Potter describes an apron device. However, Potter's device is geared toward fisherman and requires tie straps to use their device, has no belt attachment nor storage container. U.S. Pat. No. 5,181,275 to Spulgis describes another apron device. However, Spulgis is limited toward protecting the lap area of the user. There is no description for protecting the upper torso, nor any type of belt storage container. U.S. Pat. No. 5,457,820 to Yielding describes a bib device. However, Yielding is directed toward a bib for toddlers to wear in car seats and strollers. Yielding has no application to adult use and has no belt connections, nor storage containers for their device.

SUMMARY OF THE INVENTION

The first objective of the present invention is to provide a portable garment protector that will contain spilled materials.

The second objective of the present invention is to provide a portable garment protector that will effectively protect the user from both liquid and solid spillage.

The third objective of the present invention is to provide a portable garment protector that will protect the upper torso, the lap, thigh area and legs of the user.

The fourth objective of the present invention is to provide a portable garment that will have side channels that will prevent spillage from reaching the user.

The fifth objective of the present invention is to provide a portable garment protector that is adjustable for different sized users.

The sixth objective of the present invention is to provide a portable garment protector that can be used by operators and passengers using all types of vehicles such as but not limited to automobiles, trains, airplanes, buses, ships, boats, and the like.

The seventh objective of the present invention is to provide a portable garment protector that can be washed in a conventional laundry machines.

The eighth objective of the present invention is to provide a portable garment protector that will be easy to deploy and install.

The ninth objective of the present invention is to provide a portable garment protector that can be used with a belt and carried around the waist, outside the vehicle, and be deployed whenever needed.

The tenth objective of the present invention is to provide a portable garment protector having a catch basin in the lap area that collects foods and liquids from spilling further over the wearer.

A preferred embodiment of the portable garment protector device for protecting a wearer from spilled liquids and foods includes a pliable container having a zippered or Velcro® opening, and a rear strap for attaching the container to an optional belt worn around a user's waist, or to the seat belt in a vehicle and include resuable materials that can be machine washed. A first flexible reusable sheet can be rolled within the container and when removed wraps about a user's neck to protect an upper front torso region of the user. A second flexible reusable sheet is also rolled within the container and when removed protects the lower front torso region of the user. The first and second flexible reusable sheets can include a top absorbent layer such as cotton, open celled foam and the like, and a bottom water resistant layer formed from material such as but not limited to nylon, plastic sheaths, combinations thereof, and the like. Plastic spill guards on opposite side edges of the first flexible sheet can be incorporated for preventing splashed liquids and foods from touching sides of the user. Additional spill guards on opposite side edges of the second flexible sheet and across the bottom of the second flexible sheet can also be used for preventing splashed liquids and foods from touching the lower thigh and leg sides of the user. The spill guards can include inwardly bent flanges forming channels for channelling the splashed liquids and foods. A catch basin can also be incorporated across the first flexible sheet to also catch spilled liquids and food falling down the front chest area of the user, or to store the food while eating. The first and second flexible sheets can be stored on spring loaded pins within the storage container for allowing the user to easily roll up the sheets.

Alternatively, the first and the second flexible sheets can be made from a disposable material having perforated edges for allowing additional first flexible sheets and additional second flexible sheets to be attached thereon.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1A:
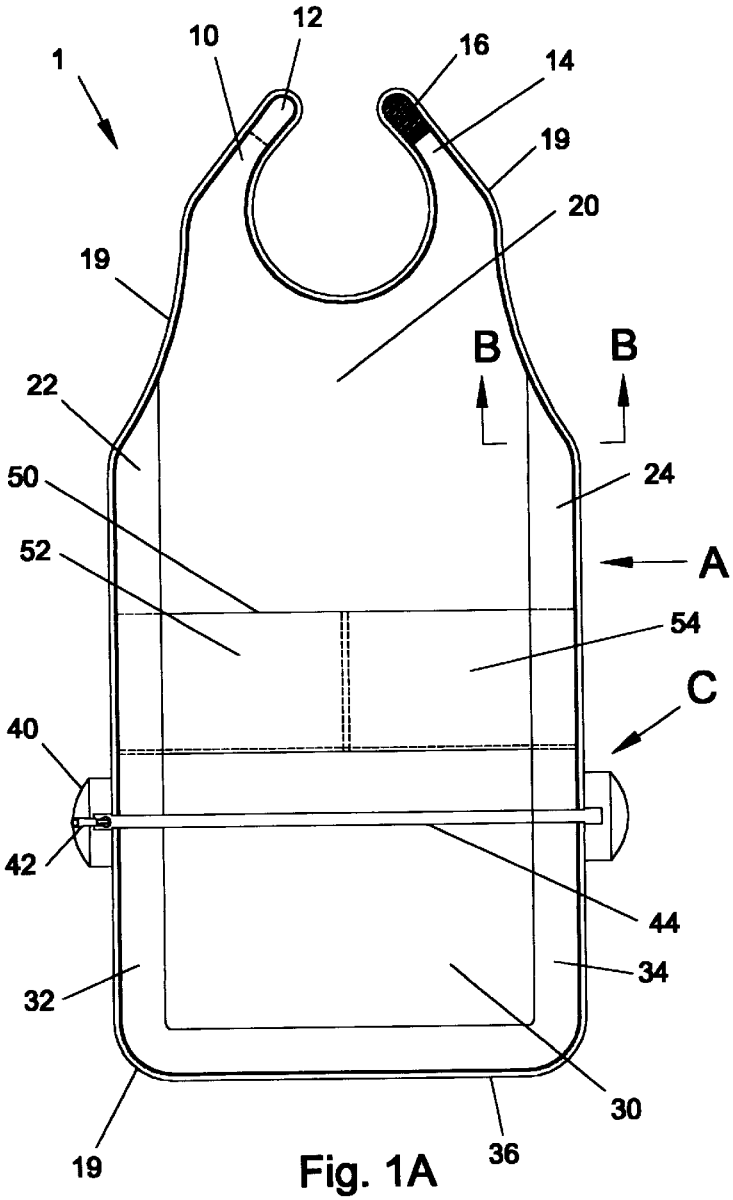
FIG. 1A is a front view of a first preferred embodiment of the portable garment protector invention.
Figure 1B:
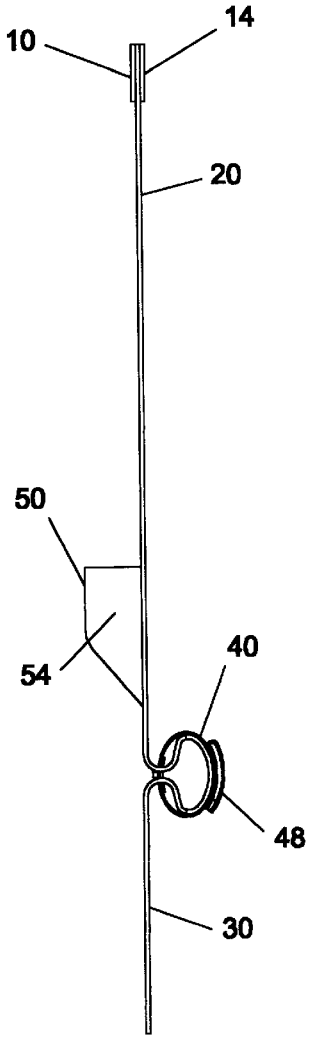
FIG. 1B is a side view of the portable garment protector of FIG. 1A along arrow A.
Figure 1C:
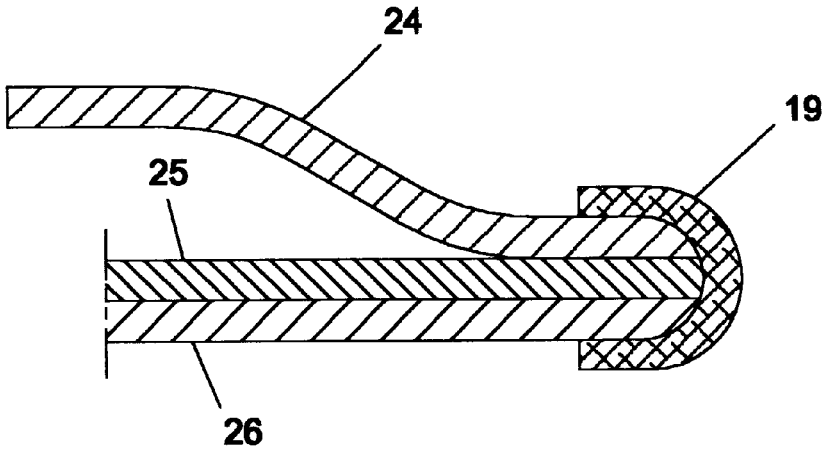
FIG. 1C is an enlarged cross-sectional view of part of the upper torso portion of the garment protector of FIG. 1A along arrow B—B.
Figure 2A:
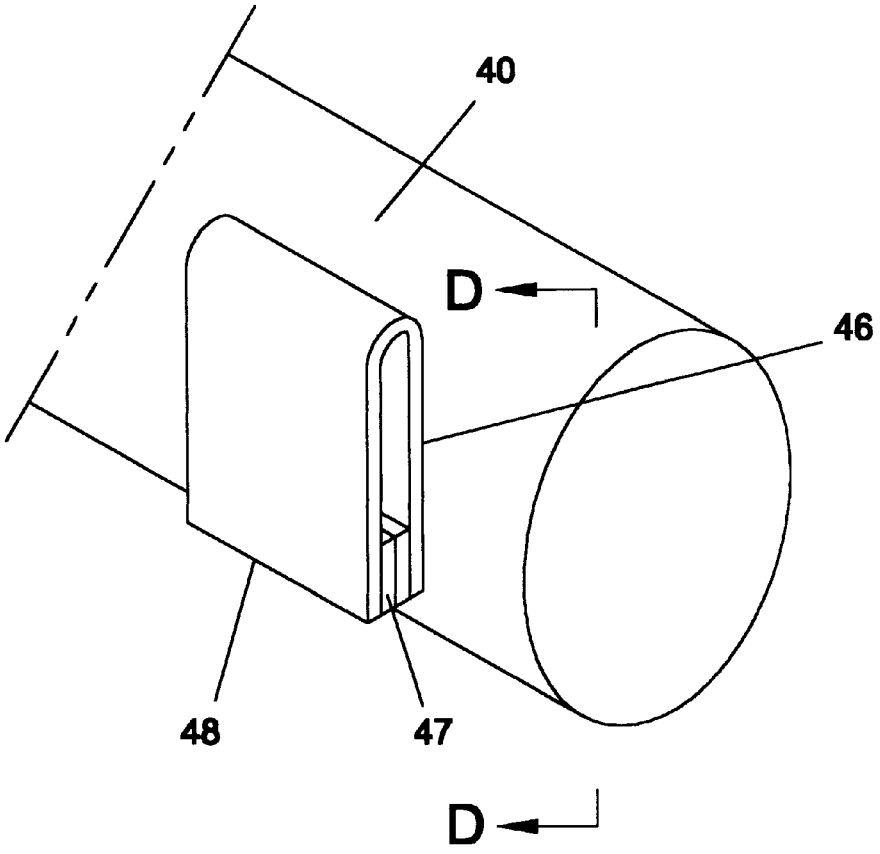
FIG. 2A is a perspective view of a portion of the storage container used in FIG. 1A along arrow C.
Figure 2B:
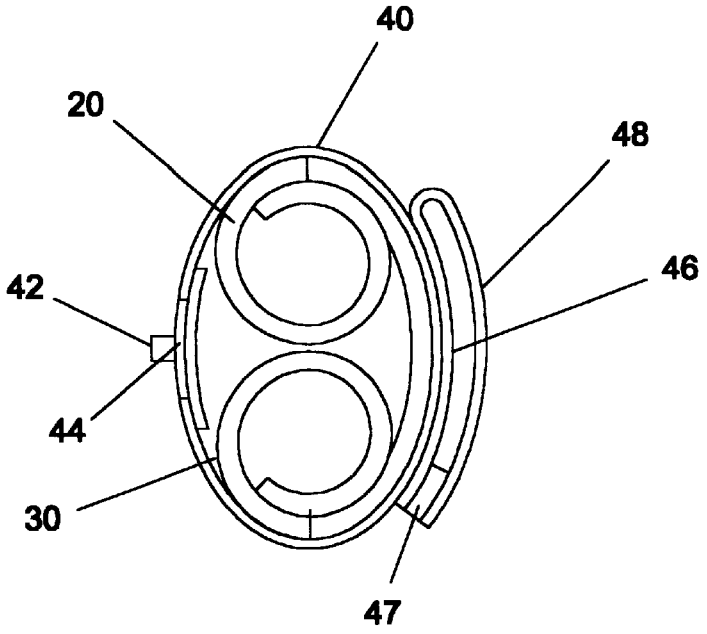
FIG. 2B is a side cross-sectional view of the storage container of FIGS. 1B and 2A along arrow D with the portable garment in a stored position.
Figure 2C:
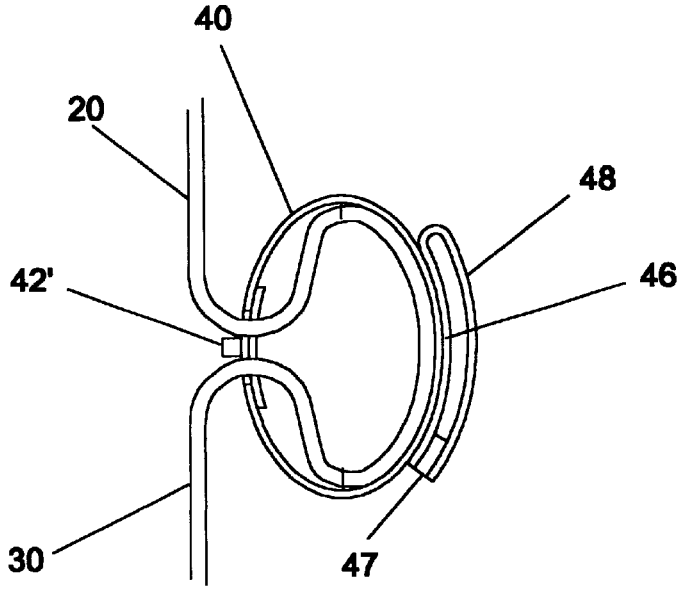
FIG. 2C is a side cross-sectional view of the storage container of FIG. 2B with the portable garment in a deployed position.

FIG. 1A is a front view of a first preferred embodiment 1 of the portable garment protector invention. FIG. 1B is a side view of the portable garment protector 1 of FIG. 1A along arrow A. FIG. 1C is an enlarged cross-sectional view of part of the upper torso portion 20 of the garment protector 1 of FIG. 1A along arrow B—B. FIG. 2A is a perspective view of a portion of the storage container 40 used in FIG. 1A along arrow C. FIG. 2B is a side cross-sectional view of the storage container 40 of FIG. 1B and 2A along arrow D with the portable garment 1 in a stored position. FIG. 2C is a side cross-sectional view of the storage container 40 of FIG. 23 with the portable garment 1 in a deployed position.

Referring to FIGS. 1A–2C, garment protector 1 include an upper torso protective portion 20, having first neck connecting strap 10 with first fastener 12, that attaches to second fastener 16 on second neck connecting strap 14. First fastener 12 and second fastener 16 can be hook and loop fasteners such as Velcro®, and the like. Additionally, the amount of fastener material can be long enough to be useful for wearers having different neck sizes, and body shapes. Along one side of upper torso portion 20 is a first spill guard 22 forming an expandable plastic flap which forms a channel for catching spilling food and liquid from touching the sides of the wearer. Similarly opposite front side has a second spill guard 24 forming another expandable plastic flap.

Referring to FIG. 1C, upper torso portion 20 has an underlying layer of water propellant type material 26 such as nylon sheath, plastic sheath, combinations thereof, and the like. Adhered by glue, stitching, and the like, is an upper overlying absorbant layer 25, which can be cotton, open cell foam, towel type material, and the like. A heat formed plastic edge piping or cloth type material 19, (which alternatively can be sewn) completely surrounds the upper torso portion edges around and about first upper side spill guard 22, neck straps 10, 14 and second upper side spill guard 24. Upper torso protection portion 20 protects the wearers chest and upper lap areas from spilled liquids and foods, and side guards 22, 24 protects the wearer's sides from the splashed liquids and foods. Additionally, an expandable lap catcher basin 50 formed of similar material as that of upper torso 20, can be sewn, heat glued and the like to the mid area of garment protector 1, and can include two pouches 52 and 54 for catching additional spilled and splashed liquids and foods, or storing food while eating.

Referring to FIGS. 1A–2C, garment protector 1 further includes a lower torso protective portion 30 includes first lower side spill guard 34 running down one edge, a bottom width spill guard 36 running across the lower edge and second lower side spill guard 32 running down the opposite edge to the first lower side spill guard 34, all of which are made of the same material and layers as those used in the upper torso protection portion 20. Lower torso protective portion 30 protects the lap, waist, thighs and legs of the wearer from spilled liquids and foods. In addition side and bottom guards 34, 36, and 32 protect the wearer's lower sides and lower leg areas from splashed liquids and foods.

Referring to FIGS. 1A–2C, garment protector 1 includes flexible elliptically shaped storage container 40 formed from flexible material such as nylon, plastic sheathing and the like. Container 40 has a front side with a zipper tab 42 that locks zipper teeth 44 together in order to allow upper torso portion 20 and lower torso portion 30 to be rolled up separately inside the container 40 as shown in FIG. 23. The rear side of container 40 has curved straps 46, 48 having a detachable fasteners 47, such as but not limited to hook and loop fasteners (i.e. Velcro®), and the like, to be able to be attached to a wearers front belt.

Figure 3A:
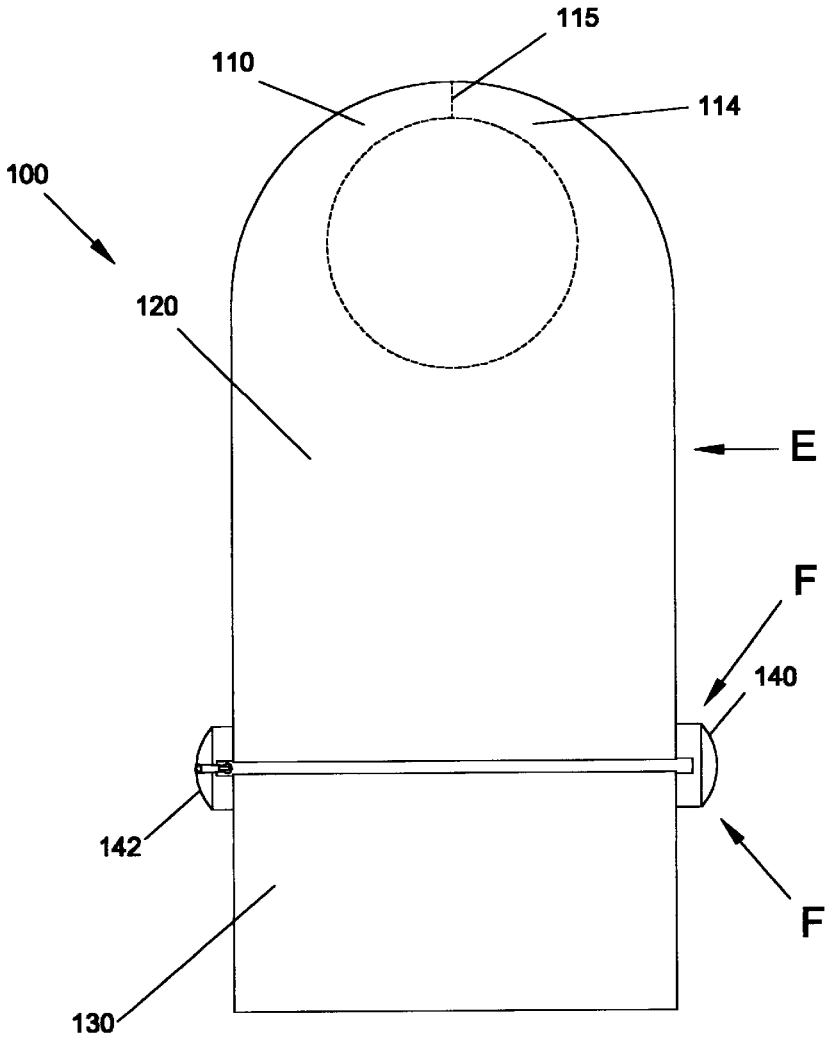
FIG. 3A is a front view of a second preferred embodiment of the portable garment protector.
Figure 3B:
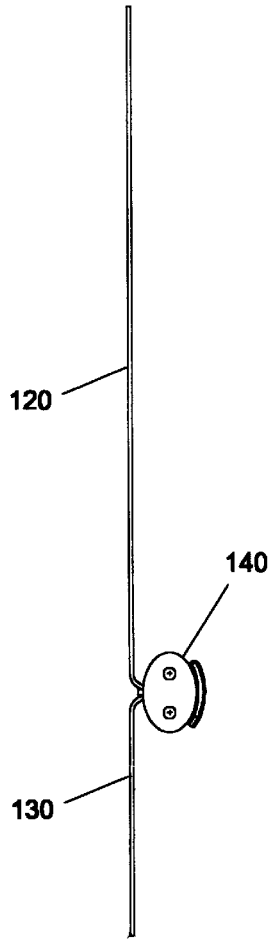
FIG. 3B is a side view of the portable garment protector of FIG. 3A along arrow E.

FIG. 3A is a front view of a second preferred embodiment 100 of the portable garment protector. FIG. 3B is a side view of the portable garment protector 100 of FIG. 3A along arrow E. Referring to FIGS. 3A–3B, embodiment 100 includes upper torso portion 120, with neck strap portions 110, 114, 115, and lower torso portion 130 which correspond to similar components of the preceding figures. Alternatively, the upper neck straps 110 and 114 can be a single piece of material that does not separate allowing the user to slip the neck straps completely over the user's head to be immediately used.

Figure 4A:
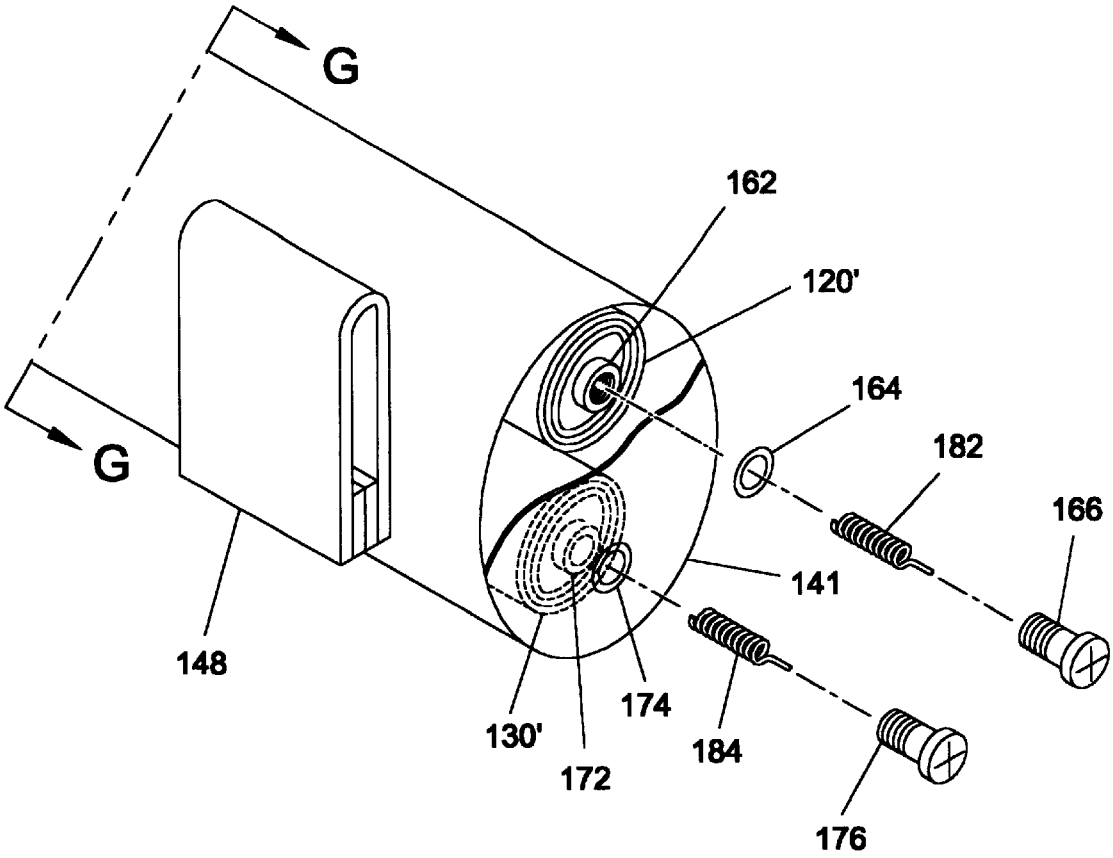
FIG. 4A is a perspective view of a portion of the storage container used in FIG. 3A along arrow F.
Figure 4B:
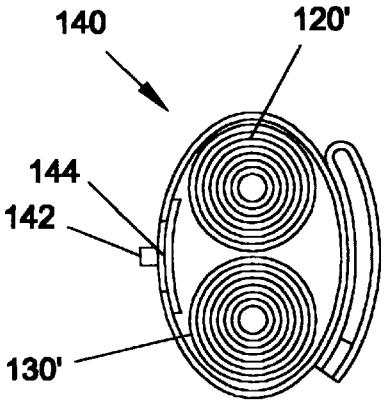
FIG. 4B is a side cross-sectional view of the storage container of FIG. 4A along arrow G.

FIG. 4A is a perspective view of a portion of the storage container 140 used in FIG. 3A along arrow F. FIG. 43 is a side cross-sectional view of the storage container 140 of FIG. 4A along arrow G. Referring to FIGS. 4A–4B, container 140, zipper tab 142 and zipper fasteners 144 and belt strap 148 are formed of similar materials to that of similar numbered components of the preceding figures. Container 140 includes rolled upper torso portion 120', rolled lower torso portion 130' and end fasteners including screws 166, 176 through sidewall 141, gromets 164, 174, and internal threaded cylinders 162, 172 for supporting the rolled up portions 120', 130' within the container 140. Gromets 164, 174 are sewn or molded into container/bag 140 so that screws 166, 176 don't cause the container/bag 140 to tear. An optional internal spring 182, 184 within the cylinders 162, 172 can allow the rolled up portions 120', 130' to have a spring loaded tension for allowing the portions 120', 130' to be more easily rolled up within container 140 for storage.

Figure 5A:
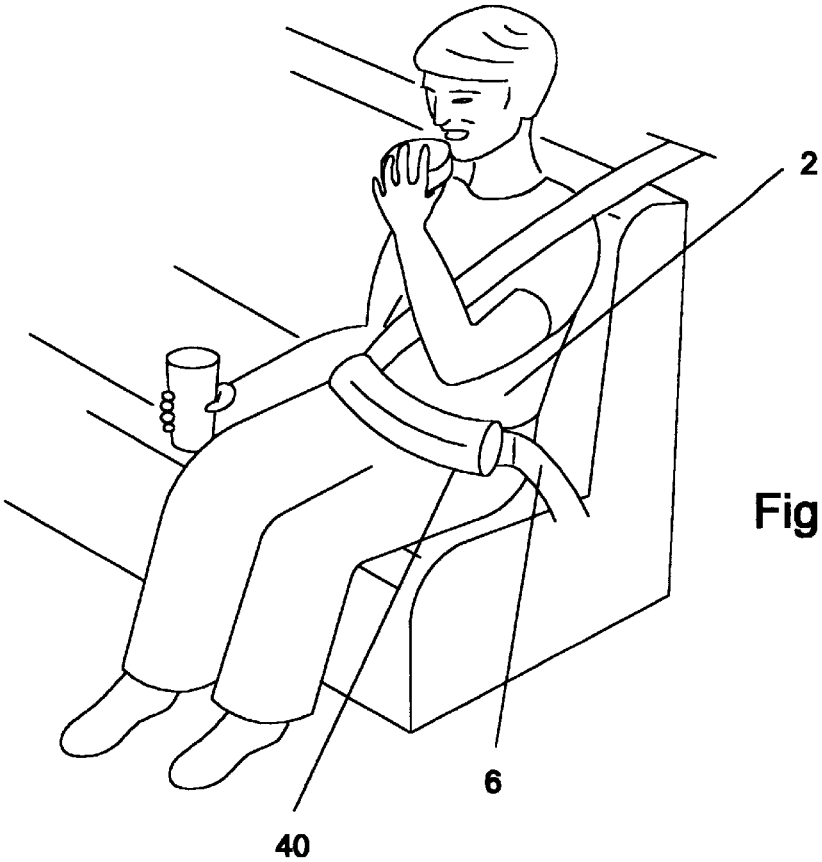
FIG. 5A is a perspective view of a driver/passenger wearing the portable garment protector invention of the preceding figures in a stored position.
Figure 5B:
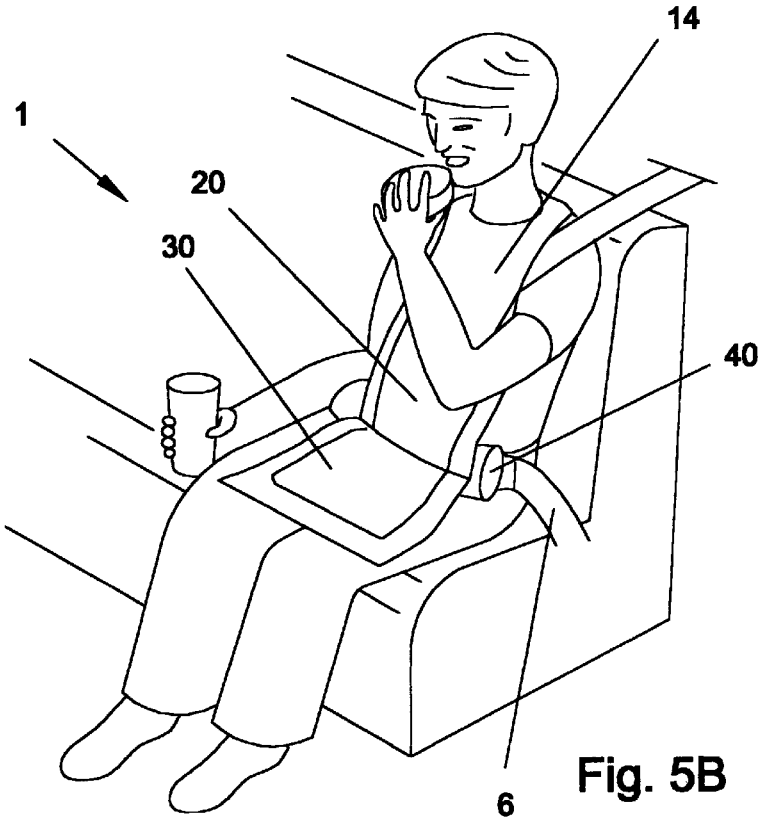
FIG. 5B is another view of the driver/passenger of FIG. 5A wearing the portable garment protector of FIG. 5A in a deployed position.

FIG. 5A is a perspective view of a driver/passenger 2 wearing the portable garment protector invention 1 of the preceding FIGS. 1A–2C in a stored position within container 40 that is attached to a seat belt 6. FIG. 5B is another view of the driver/passenger 2 of FIG. 5A wearing the portable garment protector 1 with upper rolled out upper torso portion 20 and lower rolled out lower torso portion 30 of FIG. 5A in a deployed position. The portable garment protector 1 can be attached to any person whether or not being a driver, passenger of a vehicle, or in another environment. The container 40 for the garment protector 1 can also be worn around the waist by an optional belt by the user 2, allowing the user to physically carry the invention all the time.

Figure 6:
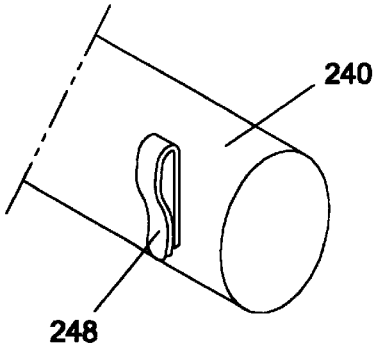
FIG. 6 is a perspective view of a portion of another storage container embodiment used in the garment protector invention having a clip attachment.

FIG. 6 is a perspective view of a portion of another storage container embodiment 240 used in the garment protector invention having a plastic pre-bent clip attachment 248 that is bent in a C-shape for allowing the wearer to clip the container 240 onto a user's belt or a vehicle seatbelt.

The reusable flexible plastic sheaths, nylon material, and absorbant material used in the invention allows the user to be able to clean the invention in a washing machine for later reuse.

Figure 7:
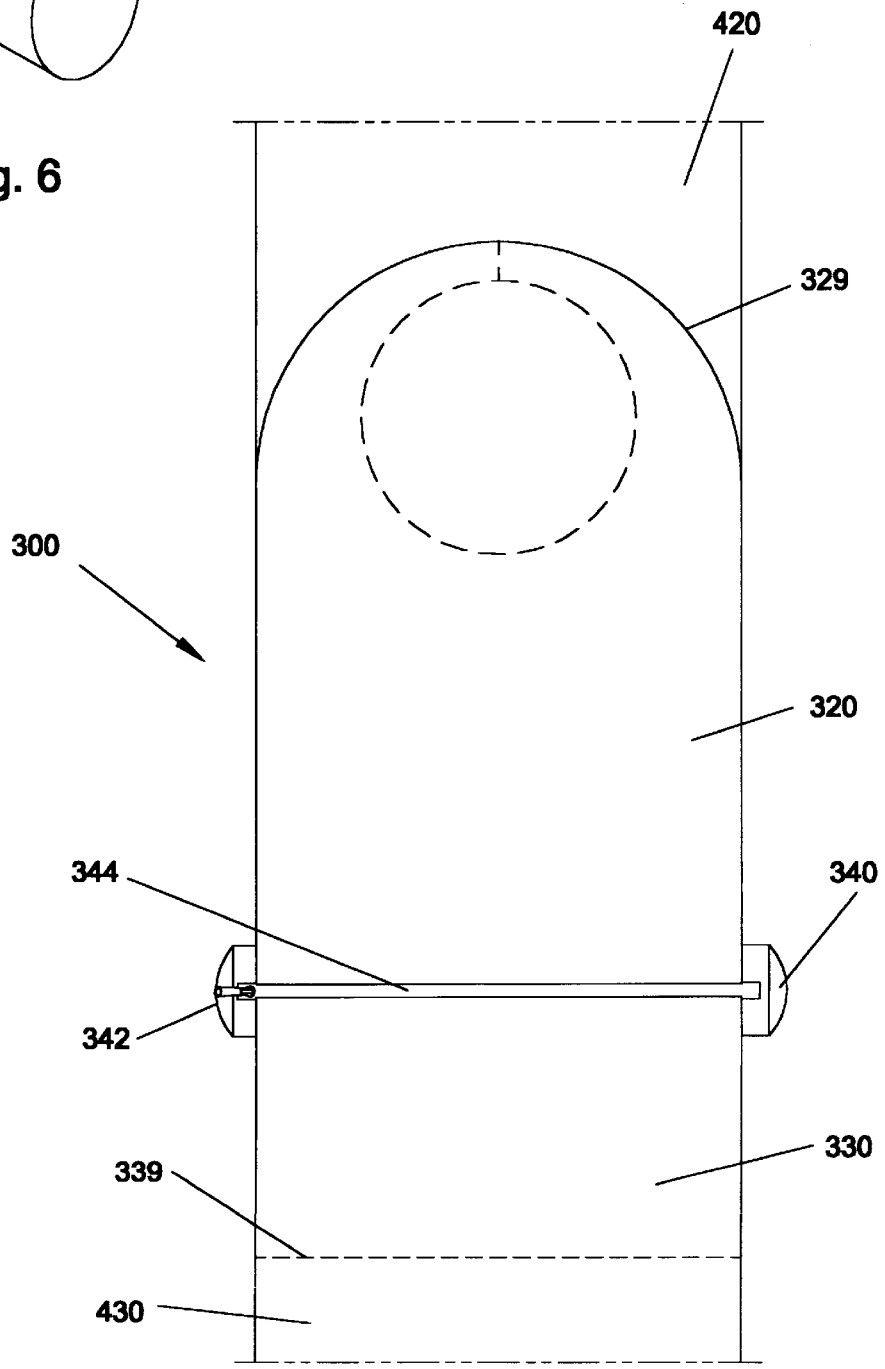
FIG. 7 is a front view of another preferred embodiment of using disposable torso protection sheets that can be unrolled from a belt attached container.

FIG. 7 shows a front view of another preferred embodiment 300 of using disposable protector portions that can be removed by opening zipper 342, 344 on storage container 340. Upper torso portion 320 can be part of a roll of additional upper torso portions 420 which are connected together by perforated edges 329. Lower torso portion 330 can likewise be connected together at perforated edge 339 by additional lower torso portion 430. The upper and lower portions can be formed from a disposable thin plastic sheaths, waxed paper, and the like, wherein the rolls can be easily replaced when fully used up.

The materials used for the protector device can have logos, advertisements, and the like, applied to front visible portions silk screening, coloring, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A portable garment protector device for protecting a wearer from spilled liquids and foods, comprising:

a container having a opening, and a strap for attaching the container to a user;

a first flexible sheet stored within the container for being removed out the opening of the container to protect an upper front torso region of the user; and a second flexible sheet stored within the container for being removed from the container to protect a lower front torso region of the user, wherein the first and the second sheet prevent spilled liquids and foods from physically touching the user.

2. The portable garment protector device of claim 1, wherein the container includes:

a zipper across the opening of the container.

3. The portable garment protector device of claim 1, wherein the container includes:

hook and loop fasteners across the opening of the container.

4. The portable garment protector device of claim 1, wherein the strap on the container includes:

a fastener for attaching the strap to a clothing belt worn by the user.

5. The portable garment protector device of claim 1, wherein the strap on the container includes:

a fastener for attaching the strap to a vehicle seat belt worn by the user.

6. The portable garment protector device of claim 1, wherein the first flexible sheet and the second flexible sheet each includes:

a top absorbent layer; and a bottom water resistant layer attached to the top absorbent layer.

7. The portable garment protector device of claim 1, further comprising:

first spill guards on opposite side edges of the first flexible sheet for preventing splashed liquids and foods from touching sides of the user.

8. The portable garment protector device of claim 7, further comprising:

second spill guards on opposite side edges of the second flexible sheet for preventing the splashed liquids and foods from touching the sides of the user.

9. The portable garment protector device of claim 7, wherein the first spill guards include:

inwardly bent flanges forming channels for channelling the splashed liquids and foods.

10. The portable garment protector device of claim 8, wherein the first spill guards and the second spill guards each include:

inwardly bent flanges forming channels for channelling the splashed liquids and foods.

11. The portable garment protector device of claim 1, further comprising:

a bottom spill guard across a width portion of the second flexible sheet for preventing splashed liquids and foods from touching the user.

12. The portable garment protector device of claim 1, further comprising:

a catch basin across the first flexible sheet for catching the spilled liquids and food.

13. The portable garment protector device of claim 1, wherein the first flexible sheet includes:

an upper strap for attaching the first flexible sheet about a neck of the user.

14. The portable garment protector device of claim 1, wherein the upper strap includes:

hook and loop fasteners.

15. The portable garment protector device of claim 1, further comprising:

an upper axle pin within the container for supporting the first flexible sheet; and a lower axle pin within the container for supporting the second flexible sheet, wherein the upper and lower axle pins allow the first and the second flexible sheets to be rolled thereon.

16. The portable garment protector device of claim 15, further including:

a spring means for allowing the upper axle pin and the lower axle pin to be able to rewind within the container when not being used.

17. The portable garment protector device of claim 1, wherein the first and the second flexible sheets include:

washable and reusable material.

18. The portable garment protector device of claim 1, wherein the first and the second flexible sheets include:

disposable material.

19. The portable garment protector device of claim 18, further including:

perforated edges for allowing additional first flexible sheets and additional second flexible sheets to be attached thereon.

* * * * *